US007263305B2

(12) United States Patent
Fujino

(10) Patent No.: US 7,263,305 B2
(45) Date of Patent: Aug. 28, 2007

(54) IMAGE HEATING APPARATUS AND FIXING APPARATUS

(75) Inventor: Takeshi Fujino, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 180 days.

(21) Appl. No.: 11/142,394

(22) Filed: Jun. 2, 2005

(65) Prior Publication Data

US 2005/0276624 A1 Dec. 15, 2005

(30) Foreign Application Priority Data

Jun. 14, 2004 (JP) ..... 2004-175629

(51) Int. Cl.
*G03G 15/20* (2006.01)

(52) U.S. Cl. ..... 399/69

(58) Field of Classification Search ..... 399/67–70
See application file for complete search history.

(56) References Cited

U.S. PATENT DOCUMENTS 5,329,343 A * 7/1994 Saito ..... 399/70
6,795,661 B2 9/2004 Kanesawa et al. ..... 399/69
2003/0180063 A1 9/2003 Kanesawa et al. ..... 399/69

FOREIGN PATENT DOCUMENTS

JP 04136970 A * 5/1992
JP A-2001-134064 5/2001
JP A-2002-067450 3/2002
JP 2002-365967 12/2002
JP 2003-270991 9/2003
JP 2004085907 A * 3/2004

* cited by examiner

*Primary Examiner*—David M. Gray
*Assistant Examiner*—Ryan Gleitz
(74) *Attorney, Agent, or Firm*—Fitzpatrick, Cella, Harper & Scinto

(57) ABSTRACT

An image heating apparatus including: a first image heating unit for heating a toner image on a recording material; a second image heating unit for heating the toner image on the recording material heated by the first image heating unit; and a detecting unit for detecting a temperature of the first image heating unit, wherein the image heating apparatus is operable to a correcting mode in which a temperature of the second image heating unit is corrected in accordance with the detected temperature of the first image heating unit.

20 Claims, 14 Drawing Sheets

FIG. 13

| CONDITION COEFFICIENT k | | BASIS WEIGHT [g] | | | |
|---|---|---|---|---|---|
| | | 80 | 100 | 160 | 200 |
| MOISTURE CONTENT [%] | 3% | -0.21 | -0.35 | -0.61 | -0.83 |
| | 5% | -0.33 | -0.42 | -0.76 | -0.98 |
| | 7% | -0.41 | -0.55 | -0.84 | -1.12 |

| CONDITION COEFFICIENT L | | BASIS WEIGHT [g] | | | |
|---|---|---|---|---|---|
| | | 80 | 100 | 160 | 200 |
| MOISTURE CONTENT [%] | 3% | -5 | -1 | 0 | 2 |
| | 5% | -1 | 0 | 2 | 3 |
| | 7% | 0 | 2 | 4 | 5 |

IMAGE HEATING APPARATUS AND FIXING APPARATUS

BACKGROUND OF THE INVENTION

1. Field of the Invention

The present invention relates to an image heating apparatus and a fixing apparatus which are used in a copying machine, a printer, a facsimile, and the like each adopting an electrophotographic system or an electrostatic recording system.

2. Related Background Art

Heretofore, one of the factors affecting an impression of a user with respect to an image outputted by an electrographic apparatus is glossiness. The glossiness preferred by a user differs depending on the user and the type of output image. In general, a text image such as an image formed of sentences is preferred to have a lower glossiness, while a graphic image such as a photograph is preferred to have a higher glossiness. However, the conventional glossiness of the image after completion of the fixing process inherently differs depending on the apparatus, and thus a user cannot select the desired value of glossiness by a high precision manner.

Here, the glossiness depends on a surface characteristic of a toner image after completion of the fixing process. In the conventional image forming apparatus, the surface characteristic depends on a material of a toner, a construction of a fixing apparatus, and the like. More specifically, the surface characteristic of a toner image after completion of the fixing process is determined during the fixing and separation. That is, the toner which is sufficiently dissolved during the fixing process is then separated so as to have the surface characteristic equal to that of a fixing roller, and thus its glossiness becomes high. On the other hand, when the toner is separated in a state where the toner is not perfectly dissolved during the fixing process, its surface becomes rough and its glossiness becomes low. However, when the toner is sufficiently dissolved during the fixing process, a high temperature offset is apt to generate, while when the toner is not perfectly dissolved, imperfect fixing is apt to generate.

As regards the factors determining the fixing characteristic, there are given a fixing temperature, a fixing nip width (a nip length along a recording material conveyance direction), a fixing speed, and the like. Thus, when the fixing temperature is set so as not to generate the imperfect fixing and the high temperature offset, the glossiness is determined accordingly. Actually, such a latitude of the fixing temperature as not to generate the imperfect fixing and the high temperature offset is narrow, and has about 10° C. for example. Hence, if the latitude is changed with this range, the glossiness hardly changes.

In addition, conventionally, an image forming apparatus is known which can select different levels of the glossiness by changing a fixing speed. However, in this case, the number of selectable levels of the glossiness depends only on the number of changeable fixing speeds. Thus, when there are two kinds of fixing speeds, two kinds of selectable levels of the glossiness are obtained accordingly. Though there are two kinds of fixing speeds, a user merely selects between the two kinds of levels of the glossiness which are determined based on the apparatus construction in advance. In addition, when the fixing speed is made slow, there arises a problem in that it takes time to output a toner image.

In order to cope with such problems, an image forming apparatus disclosed in Japanese Patent Laid-Open No. 2002-365967, as shown in FIG. 14, adopts a construction in which a toner image on a recording material is fixed by a first fixing unit A' (including a first fixing roller 101 and a first pressure roller 102), and a second fixing unit B' (including a second fixing roller 103 and a second pressure roller 104) which is provided on a downstream side with respect to the first fixing unit A'.

More specifically, a toner image t on a recording material P is fixed by the first fixing unit A', and the glossiness of the resultant toner image is adjusted by the second fixing unit B' provided on the downstream side with respect to the first fixing unit A'.

The adjustment of the glossiness is carried out by changing an attemperation temperature (target temperature) of the second fixing unit B'. That is, firstly, a function of the first fixing unit A' mainly aims at "fixing", and the setting is made in the function of the first fixing unit A' so as not to generate the above-mentioned high temperature offset and imperfect fixing. Thus, the recording material P passes through the first fixing unit A', whereby the toner image t has already been fixed. The surface characteristic and glossiness of the toner image t at this time have certain values, respectively.

A function of the second fixing unit B' mainly aims at "glossiness adjustment". Thus, the attemperation temperature of the second fixing unit B' is set so that the glossiness of the toner image has a desired value. That is, when the attemperation temperature of the second fixing unit B' is set to be low, the glossiness does not become very high, while when the attemperation temperature of the second fixing unit B' is set to be high, the glossiness becomes high. As a result, the glossiness can be changed without changing the fixing speed.

However, in the case of the image forming apparatus disclosed in Japanese Patent Laid-Open No. 2002-365967, the attemperation control for the first fixing roller 101 of the first fixing unit A' and the attemperation control for the second fixing roller 103 of the second fixing unit B' are carried out independently of each other.

Then, though a temperature of an outer surface of the first fixing roller 101 of the first fixing unit A' reaches a desired temperature at the beginning of an image forming job for continuously forming an image on a plurality of recording materials, an inner side of the first fixing roller 101 of the first fixing unit A' has not heat accumulation so much. As a result, a phenomenon occurs in which the temperature of the first fixing roller 101 decreases as the recording materials successively pass through the first fixing unit A'.

On the other hand, since the second fixing roller 103 of the fixing unit B' is brought into contact with the recording material which has already been heated in the first fixing unit A', a decrease in temperature of the second fixing roller 103 accompanying the progress of the image forming job is small.

As a result, the glossiness of the image formed on the recording material changes in the middle of the image forming job, and thus the appearance quality of the image is reduced.

SUMMARY OF THE INVENTION

It is an object of the present invention to provide an image heating apparatus which is capable of suppressing a change in glossiness of an image.

An image heating apparatus according to an aspect of the invention includes: first image heating means for heating a toner image on a recording material; second image heating means for heating the toner image on the recording material heated by the first image heating means; and detecting means for detecting a temperature of the first image heating means, wherein the image heating apparatus is operable to a correcting mode in which a temperature of the second image heating means is corrected in accordance with the detected temperature of the first image heating means.

Further, an image heating apparatus according to another aspect of the invention includes: first image heating means for heating a toner image on a recording material; first heating means for carrying out heating so that the first image heating means maintains a target temperature; second image heating means for heating the toner image on the recording material heated by the first image heating means; second heating means for carrying out heating so that the second image heating means maintains a target temperature; and correcting means for correcting the target temperature of the second image heating means in accordance with a temperature of the first image heating means.

It is another object of the present invention to provide a fixing apparatus which is capable of suppressing a change in glossiness of an image.

A fixing apparatus according to another aspect of the invention includes: first fixing means for heat-fixing a toner image on a recording material; second fixing means for heat-fixing the toner image on the recording material heated by the first fixing means; detecting means for detecting a temperature of the first fixing means; and correcting means for correcting a temperature of the second fixing means in accordance with the detected temperature of the first fixing means.

Further, a fixing apparatus according to another aspect of the invention includes: first fixing means for heat-fixing a toner image on a recording material; first heating means for heating said first fixing means so that a temperature of the first fixing means maintains a target temperature; second fixing means for heat-fixing the toner image on the recording material heated by the first fixing means; second heating means for heating the second fixing means so that a temperature of the second fixing means maintains a target temperature; and correcting means for correcting the target temperature of the second fixing means in accordance with temperature fluctuation of the first fixing means.

Other objects of the present invention will become clear by reading the following detailed description when taken in conjunction with the accompanying drawings.

BRIEF DESCRIPTION OF THE DRAWINGS

FIG. 13 is a table of the condition coefficients k and L which are obtained from four-stage basis weights of a recording material and three-stage moisture contents of the recording material when an image having glossiness of 21.5 is obtained with the construction described in a first embodiment of the present invention.

DESCRIPTION OF THE PREFERRED EMBODIMENTS

Hereinafter, the present invention will be described in more detail by giving embodiments as examples. Note that while those embodiments are merely exemplary embodiments of the present invention, the present invention is not intended to be limited to those embodiments.

First Embodiment (1) Example of Image Forming Apparatus

Figure 1:
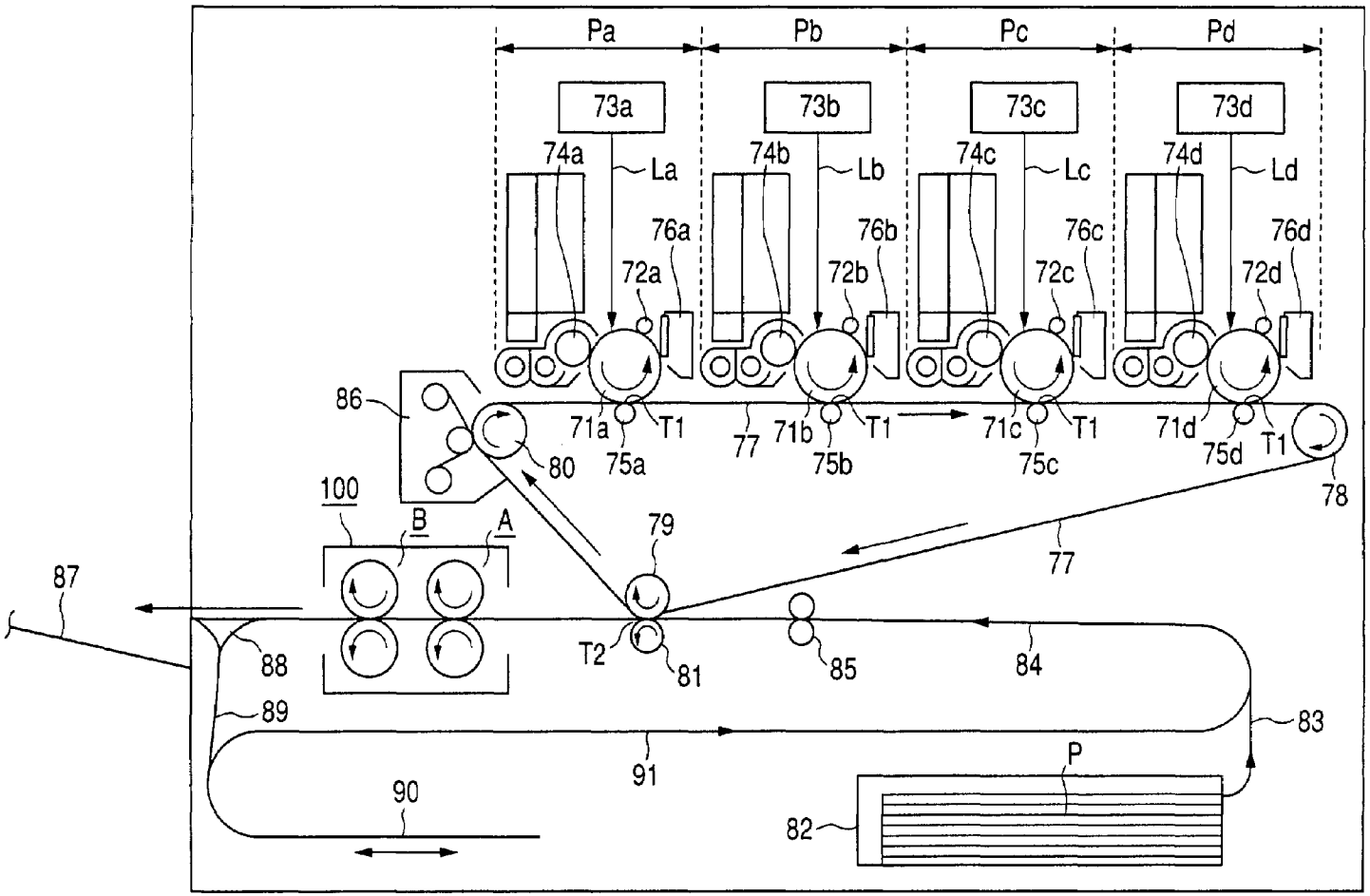
FIG. 1 is a schematic view showing a schematic construction of an example of an image forming apparatus.

FIG. 1 is a schematic view showing a schematic construction of an example of an image forming apparatus according to a first embodiment. The image forming apparatus of this example is a color laser printer using an electrophotographic process.

Four image forming portions, i.e., first, second, third, and fourth image forming portions Pa, Pb, Pc, and Pd as image forming means are provided side by side within the image forming apparatus. Toner images having different colors (cyan toner image, magenta toner image, yellow toner image, and black toner image) are formed through a latent image forming process, a developing process, and a transferring process.

The image forming portions Pa, Pb, Pc, and Pd include dedicated image bearing members, i.e., electrophotographic photosensitive drums 71*a*, 71*b*, 71*c*, and 71*d* in this example, respectively. The toner images having the respective colors are formed on the photosensitive drums 71*a*, 71*b*, 71*c*, and 71*d*, respectively. An intermediate transfer member (intermediate transfer belt) 77 is installed adjacently to the photosensitive drums 71*a*, 71*b*, 71*c*, and 71*d*. The toner images of the respective colors which have been formed on the photosensitive drums 71*a*, 71*b*, 71*c*, and 71*d*, respectively, are successively superposed and transferred to the intermediate transfer member 77 in primary transfer nip portions T1 of the image forming portions Pa, Pb, Pc, and Pd, and are then collectively, secondarily transferred to a recording material P in a secondary transfer nip portion T2. Moreover, the recording material P having the toner images transferred thereto is introduced into a fixing apparatus 100 to be subjected to a processing for fixing the toner images, and is then discharged as a color image formation thing to a delivery tray 87 provided outside the image forming apparatus. The fixing apparatus 100 is a tandem fixing apparatus having two fixing units, i.e., a first fixing unit A and a second fixing unit B. The fixing apparatus 100 will be described later.

Drum chargers 72*a*, 72*b*, 72*c*, and 72*d*, laser scanners 73*a*, 73*b*, 73*c*, and 73*d*, developing devices 74*a*, 74*b*, 74*c*, and 74*d*, primary transfer chargers 75*a*, 75*b*, 75*c*, and 75*d*, and cleaners 76*a*, 76*b*, 76*c*, and 76*d* are provided in peripheries of the photosensitive drums 71*a*, 71*b*, 71*c*, and 71*d*, respectively.

The photosensitive drums 71*a*, 71*b*, 71*c*, and 71*d* are driven to be rotated in a counterclockwise direction indicated by arrows, and their peripheral surfaces are uniformly, primarily charged with electricity so as to obtain predetermined polarities and electric potentials by the drum chargers 72*a*, 72*b*, 72*c*, and 72*d*. The uniformly charged peripheral surfaces of the photosensitive drums 71*a*, 71*b*, 71*c*, and 71*d* are scanned and exposed with laser beams La, Lb, Lc, and Ld which are modulated in accordance with an image signal to be outputted from the laser scanners 73*a*, 73*b*, 73*c*, and 73*d*, thereby forming latent images corresponding to the image signal on the photosensitive drums 71*a*, 71*b*, 71*c*, and 71*d*, respectively. That is, light source devices, polygon mirrors, and the like are installed in the laser scanners 73*a*, 73*b*, 73*c*, and 73*d*, respectively. The laser beam emitted from the light source device is scanned by rotating the polygon mirror, and the luminous flux of the scanning laser beam is deflected by a reflecting mirror and is then condensed on a generating line of the photosensitive drum by an fθ lens to expose the photosensitive drum, thereby forming the latent image corresponding to the image signal on the photosensitive drum.

Predetermined amounts of cyan toner, magenta toner, yellow toner, and black toner are filled as developers in the developing devices 74*a*, 74*b*, 74*c*, and 74*d* from supply devices, respectively. The latent images formed on the photosensitive drums 71*a*, 71*b*, 71*c*, and 71*d* are developed by the developing devices 74*a*, 74*b*, 74*c*, and 74*d* to be visualized in the form of a cyan toner image, a magenta toner image, a yellow toner image, and a black toner image, respectively.

The intermediate transfer member 77 is an endless belt member which is suspended among three parallel rollers 78, 79, and 80 under tension. The intermediate transfer member 77 is driven to be rotated in a clockwise direction indicated by arrows at the same circumferential speed as that of each of the photosensitive drums 71*a*, 71*b*, 71*c*, and 71*d*.

The first color yellow toner image which has been formed and has been born on the photosensitive drum 71*a* of the first image forming portion Pa is primarily transferred to the peripheral surface of the intermediate transfer member 77 by an electric field and a pressure which are formed based on a primary transfer bias applied from the primary transfer charger 75*a* to the intermediate transfer member 77 in a process of passing through the primary transfer nip portion T1 as a nip portion between the photosensitive drum 71*a* and the intermediate transfer member 77.

Hereinafter, similarly to the above-mentioned case, the second color magenta toner image, the third color cyan toner image, and the fourth color black toner image which have been formed and have been born on the photosensitive drums 71*b*, 71*c*, and 71*d* of the second, third, and fourth image forming portions Pb, Pc, and Pd, respectively, are successively superposed and transferred to the intermediate transfer member 77 in the respective primary transfer nip portions T1, thereby forming a composite color toner image corresponding to the objective color image on the intermediate transfer member 77.

A secondary transferring roller 81 causes the intermediate transfer member 77 to be sandwiched and pressed between the secondary transferring roller 81 and the roller 79 among the three parallel rollers 78, 79, and 80 among which the intermediate transfer member 77 is suspended under tension, thereby forming a secondary transfer nip portion T2 between the intermediate transfer member 77 and the secondary transferring roller 81.

On the other hand, one sheet of recording material P is separated and fed from a sheet feeding cassette 82, and passes through a sheet path 83, a sheet path 84, and registration rollers 85 to be fed to the secondary transfer nip portion T2 as an abutting portion between the intermediate transfer member 77 and the secondary transferring roller 81 at a predetermined timing. At the same time, a secondary transfer bias is applied from a bias power source to the secondary transfer nip portion T2. As a result, the composite color toner image which has been obtained by superposing and transferring the first yellow toner image, the second color magenta toner image, the third color cyan toner image, and the fourth color black toner image to the intermediate transfer member 77 is secondarily transferred to the recording material P.

The recording material P to which the composite color toner image has been transferred in the secondary transfer nip portion T2 is separated from the intermediate transfer member 77, and is then introduced into the fixing apparatus (image heating apparatus) 100. In the fixing apparatus 100, the recording material P is firstly introduced into the first fixing unit A (first image heating means) as a first fixing means, and is secondly introduced into the second fixing unit B (second image heating means) as a second fixing means. The composite color toner image is heated and pressurized to be fixed to the recording material P while the recording material P successively passes through the series-disposed two fixing units, i.e., the first fixing unit A and the second fixing unit B.

The photosensitive drums 71*a*, 71*b*, 71*c*, and 71*d* after completion of the primary transfer job are cleared and removed with their residual toners remaining after completion of the primary transfer job by the respective cleaners 76*a*, 76*b*, 76*c*, and 76*d* to be continuously prepared for the jobs in and after formation of next latent images.

A cleaning web (non-woven fabric) of a web cleaning device 76 is brought into contact with the surface of the transferring belt 77 to wipe off the residual toners and other foreign materials which remain on the intermediate transfer belt 77 as the intermediate transfer member 77.

In a case where a duplex copying mode is selected, the recording material P on a first surface side of which the image was formed and which has been discharged from the fixing apparatus 100 is introduced into a sheet path 89 side on a re-circulating conveyance mechanism side by a flapper 88. Moreover, the recording material P enters a switchback sheet path 90 and is then drawn from the switchback sheet path 90 to be induced into a re-conveyance sheet path 91.

Then, after having been induced into the re-conveyance sheet path 91, the recording material P passes through the sheet path 84 and the registration rollers 85 to be introduced into the secondary transfer nip portion T2 again with the recording material P being turned inside out at a predetermined timing. As a result, a toner image formed on the intermediate transfer member 77 is secondarily transferred to a second surface side of the recording material P. The recording material P to the second surface of which the toner image has been secondarily transferred in the secondary transfer nip portion T2 is separated from the intermediate transfer member 77 to be introduced into the fixing apparatus 100 again. The recording material P is then subjected to the processing for fixing the toner image to be discharged as a duplexly copied sheet to the delivery tray 87.

(2) Fixing Apparatus (Image Heating Apparatus) 100

Figure 2:
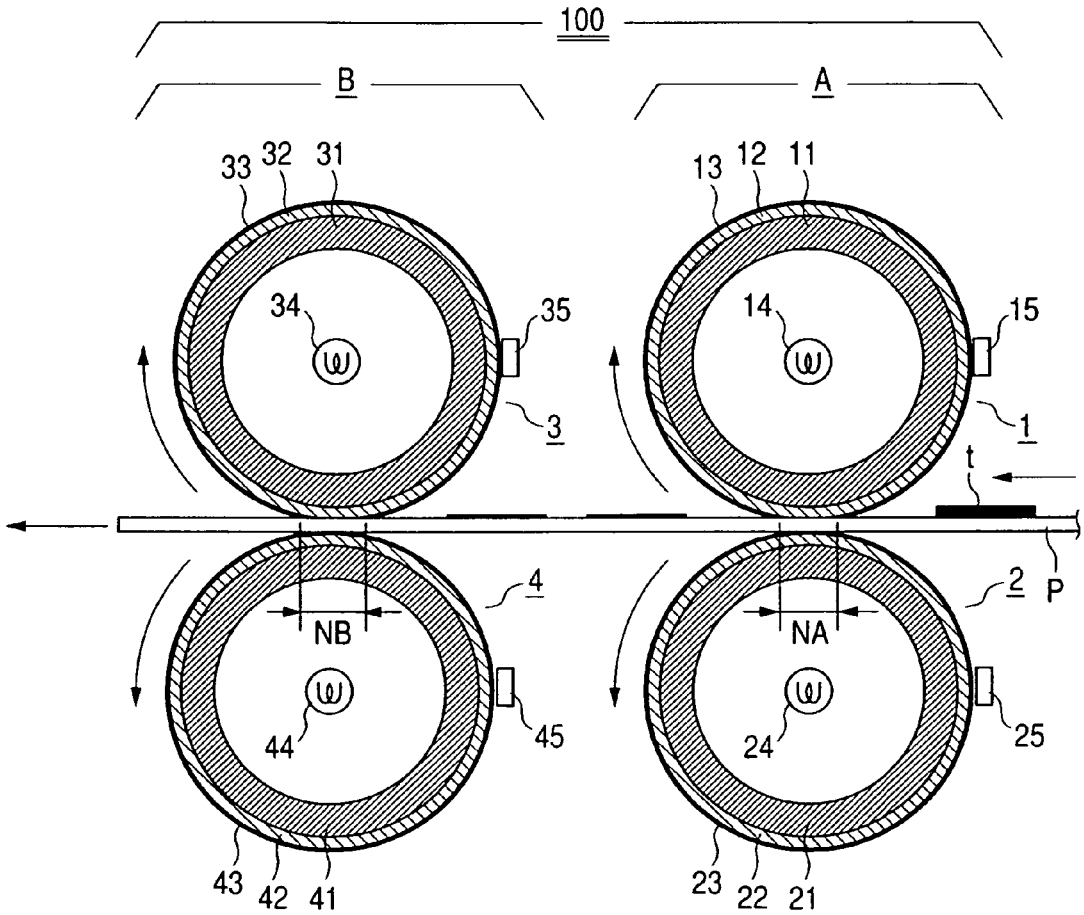
FIG. 2 is an enlarged schematic view of a fixing apparatus portion.

FIG. 2 is an enlarged schematic view of a fixing apparatus 100 portion. The fixing apparatus 100 is provided with a first fixing unit A (first image heating means) as a first fixing means which includes a first heating member (fixing member) and a first pressure member and which forms a first nip portion NA. Moreover, the fixing apparatus 100 is also provided with a second fixing unit B (second image heating means) as second fixing means which is disposed on a downstream side in a recording material conveyance direction with respect to the first fixing unit A, which includes a second heating member (fixing member) and a second pressure member, and which forms a second nip portion NB.

The fixing apparatus 100 is one, utilizing a so-called tandem fixing system, for successively inserting the recording material P through the first nip portion NA and the second nip portion NB, thereby fixing the toner image t to the recording material P.

Figure 3:
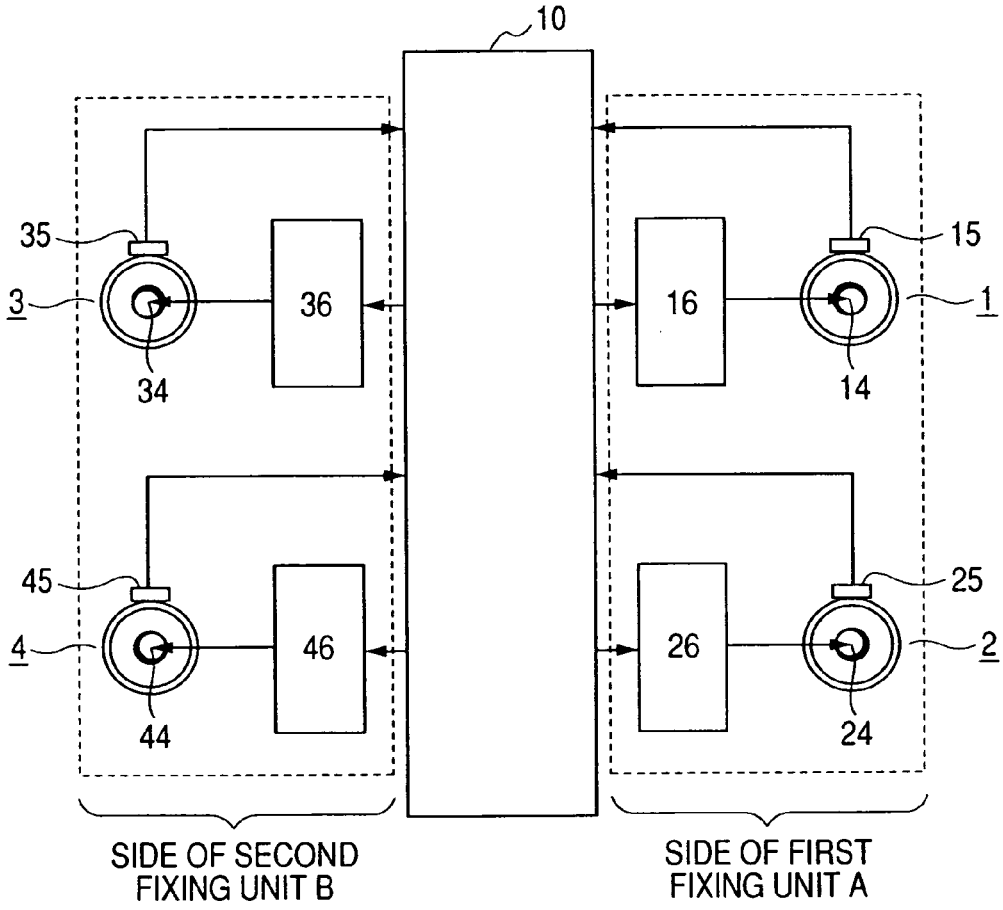
FIG. 3 is a block diagram of an attemperation system of the fixing apparatus.

Note that a construction is adopted in which a temperature of the first fixing unit A (first heating member) and a temperature of the second fixing unit B (second heating member) are controlled by an attemperation means (FIG. 3).

1) First Fixing Unit A

In the first fixing unit A, the first heating member is constructed as a first fixing roller 1 with a diameter of 45 mm in which an elastic layer 12 made of a silicon rubber material with a thickness of 500 μm is formed on a core metal 11 made of an aluminum material with a thickness of 1.0 mm, and a release layer 13 made of a PFA tube with a thickness of 20 μm is formed on the elastic layer 12. In addition, a halogen heater 14 as heating means is provided inside the first fixing roller 1. Also, a thermister 15 as detecting means for detecting a temperature of an external surface of the first fixing roller 1 subjected to be heated by the halogen heater 14 is provided on the first fixing roller 1.

In addition, the first pressure member is constructed as a first pressure roller 2 with a diameter of 30 mm in which an elastic layer 22 made of a silicon rubber material with a thickness of 500 μm is formed on a core metal 21 made of an aluminum material with a thickness of 1.0 mm, and a release layer 23 made of a PFA tube with a thickness of 20 μm is formed on the elastic layer 22. In addition, a halogen heater 24 as heating means is provided inside the first pressure roller 2. Also, a thermister 25 as detecting means for detecting a temperature of an external surface of the first pressure roller 2 subjected to be heated by the halogen heater 24 is provided on the first pressure roller 2.

The first fixing roller 1 and the first pressure roller 2 are pressed against each other by pressure means (not shown), thereby forming the first fixing nip portion NA in the first fixing unit A. The first fixing roller 1 and the first pressure roller 2 are driven to be rotated in respective directions indicated by arrows by a driving mechanism (not shown).

In FIG. 3, an attemperation circuit (or "controller") 10 as control means is electrically connected to the halogen heaters 14 and 24 through the above-mentioned thermisters 15 and 25, and power source circuits 16 and 26, respectively. Normally, the attemperation circuit 10 controls the halogen heater 14 and the halogen heater 24 in accordance with detection results of the thermister 15 and detection results of the thermister 25, respectively. That is, the temperature control is carried out so that the first fixing roller 1 and the first pressure roller 2 maintain predetermined target temperatures, respectively.

During application of A.C. 100 V, electric powers of 800 W and 400 W are used as wattages for the halogen heaters 14 and 24, respectively.

2) Second Fixing Unit B

In the second fixing unit B, the second heating member 3 is constructed as a second fixing roller 3 in which an elastic layer 32 made of a silicon rubber material with a thickness of 500 μm is formed on a core metal 31 made of an aluminum material with a thickness of 1.0 mm, and a release layer 33 made of a PFA tube with a thickness of 20 μm is formed on the elastic layer 32. In addition, a halogen heater 34 as heating means is provided inside the second fixing roller 3. Also, a thermister 35 as detecting means for detecting a temperature of an external surface of the second fixing roller 3 subjected to be heated by the halogen heater 34 is provided on the second fixing roller 3.

In addition, the second pressure member 4 is constructed as a second pressure roller 4 in which an elastic layer 42 made of a silicon rubber material with a thickness of 500 μm is formed on a core metal 41 made of an aluminum material with a thickness of 1.0 mm, and a release layer 43 made of a PFA tube with a thickness of 20 μm is formed on the elastic layer 42. In addition, a halogen heater 44 as heating means is provided inside the second pressure roller 4. Also, a thermister 45 as detecting means for detecting a temperature of an external surface of the second pressure roller 4 subjected to be heated by the halogen heater 44 is provided on the second pressure roller 4.

Diameters of the second fixing roller 3 and the second pressure roller 4 are 45 mm and 30 mm similarly to those of the first fixing roller 1 and the first pressure roller 2, respectively.

The second fixing roller 3 and the second pressure roller 4 are pressed against each other by pressure means (not shown), thereby forming the second fixing nip portion NB in the second fixing unit B. The second fixing roller 3 and the second pressure roller 4 are driven to be rotated in respective directions indicated by arrows by the driving mechanism (not shown).

The attemperation circuit 10 as control means is also electrically connected to the halogen heaters 34 and 44 through the above-mentioned thermisters 35 and 45, and power source circuits 36 and 46, respectively. In normal operation, the attemperation circuit 10 controls the halogen heater 34 and the halogen heater 44 in accordance with detection results of the thermister 35 and detection results of the thermister 45, respectively. That is, the temperature control is carried out so that the second fixing roller 3 and the second pressure roller 4 maintain predetermined target temperatures, respectively.

During application of A.C. 100 V, electric powers of 800 W and 400 W are used as wattages for the halogen heaters 14 and 24, respectively.

The first fixing unit A and the second fixing unit B are disposed in tandem in a recording material conveyance direction. A guide member (not shown) is provided between the first fixing unit A and the second fixing unit B. Thus, the recording material P which has been conveyed to pass through the first fixing nip portion NA with the recording material P being held in the first fixing nip portion NA is guided by the guide member to be inserted through the second fixing nip portion NB. Thereafter, the recording material P is discharged to the outside of the image forming apparatus.

3) Control for Temperatures of First Fixing Unit A and Second Fixing Unit B

Figure 4:
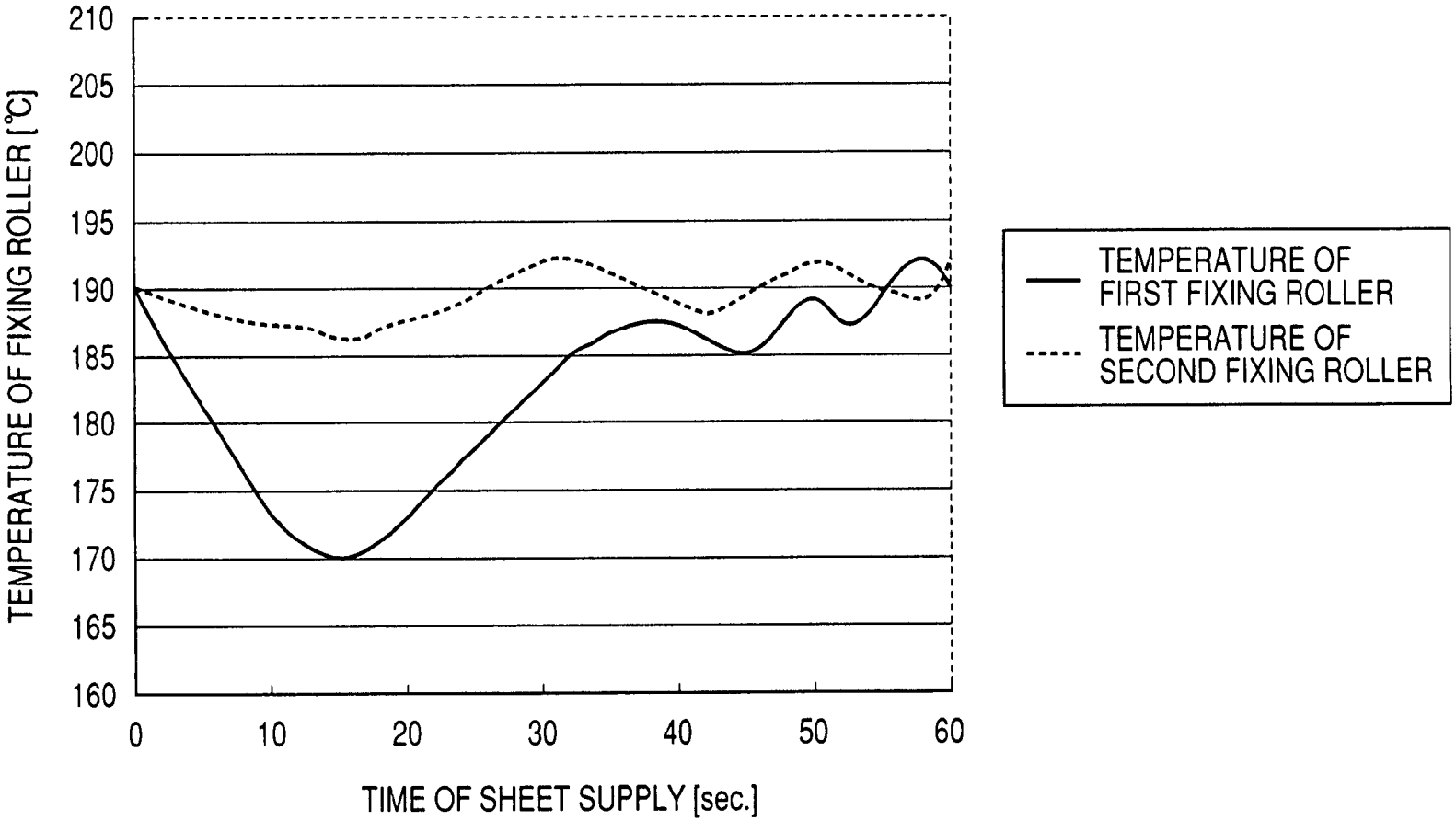
FIG. 4 is a graph representing changes in surface temperatures of a first fixing roller and a second fixing roller in a tandem fixing apparatus according to a comparative example.

Firstly, FIG. 4 shows, as a comparative example, changes in temperatures of the first fixing roller 1 and the second fixing roller 3 when the attemperation circuit is caused to control the attemperation of the first fixing unit A and the attemperation of the second fixing unit B independently of each other so that each of the temperatures of the first fixing roller 1 and the second fixing roller 3 becomes 190° C. as a target temperature. In addition, FIG. 5 is a graph showing a change in glossiness of the image on the recording material which was subjected to the fixing (heating) processing by the first fixing unit A and the second fixing unit B.

As regards the fixing processing conditions, a plain paper which is of an A4 size and has a basis weight of 100 g was used as a recording material. Also, a toner having a cyan color was formed as a color patch of 2 cm by 5 cm on the recording material. A plurality of recording materials were continuously supplied while the resultant toner image was fixed to the recording materials at a fixing speed of 120 mm/s and at a rate of 30 point per minute (PPM). The experiments were carried out under the temperature/humidity environment in which a temperature was a room temperature of 20° C., and a relative humidity was 55%. The glossiness of the image was measured with the patch image portion after completion of the fixing processing as an object using a gloss meter of a PG-1M (75°) type manufactured by Nippon Denshoku Industries Co., Ltd.

As can be seen from the graph shown in FIG. 4, the temperature of the first fixing roller 1 begins to abruptly decrease right after start of the sheet supply along with the progress of the job for continuously forming the image on a plurality of recording materials, and reaches the lowest point when 7 or 8 sheets of recording materials are supplied. Thereafter, the temperature of the first fixing roller 1 gradually rises and finally changes with about 190° C. as a center. On the other hand, a change in temperature of the second fixing roller 3 is smaller than that in temperature of the first fixing roller 1, and thus the temperature of the second fixing roller 3 changes with nearly about 190° C. as a center.

Figure 5:
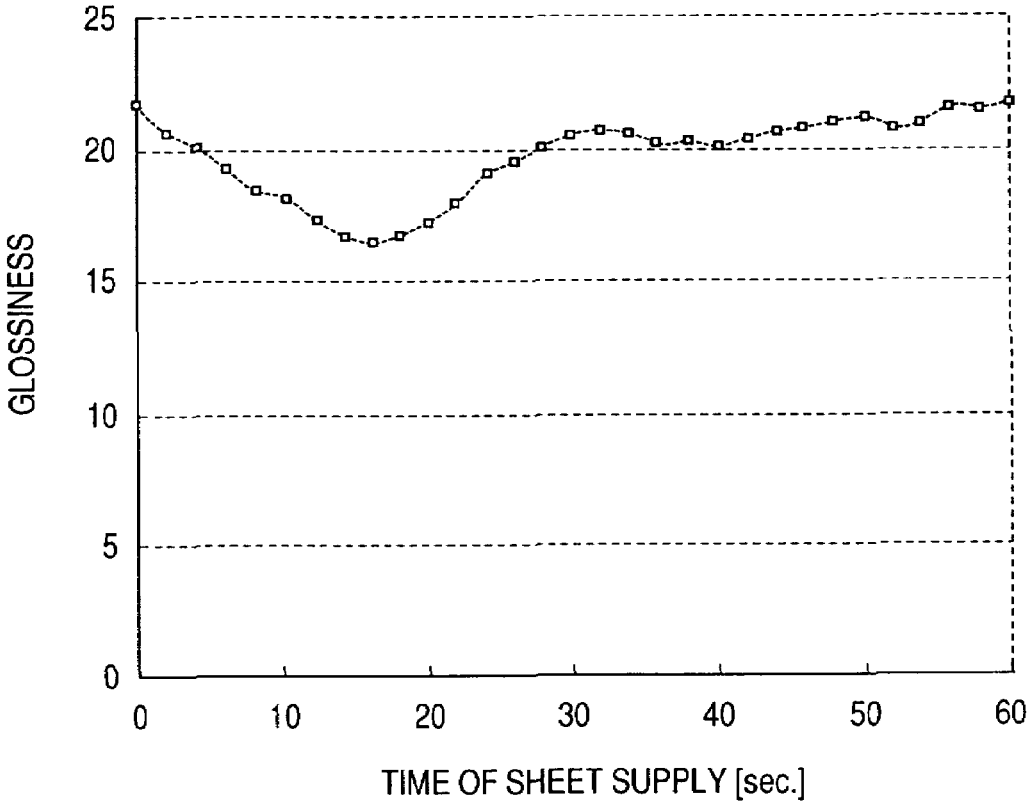
FIG. 5 is a graph representing changes in glossiness of an output image in the tandem fixing apparatus according to the comparative example.

As a result, it is understood from the graph shown in FIG. 5 that the glossiness in the vicinity of the lowest point of the temperature of the first fixing roller 1 becomes lower than that of a first sheet of recording material in this job by about 5. Thereafter, the glossiness converges to a range of about 20 to 22. That is, in the state after the temperature of the first fixing roller 1 converges to about 190° C., a change width of the glossiness is about 2 in range, while in the state before the convergence, the change width of the glossiness is twice or more as large as that after the convergence.

The graph of FIG. 4 shows that the glossiness changes in accordance with the changes in temperatures of the first fixing roller 1 and the second fixing roller 3.

Figure 6:
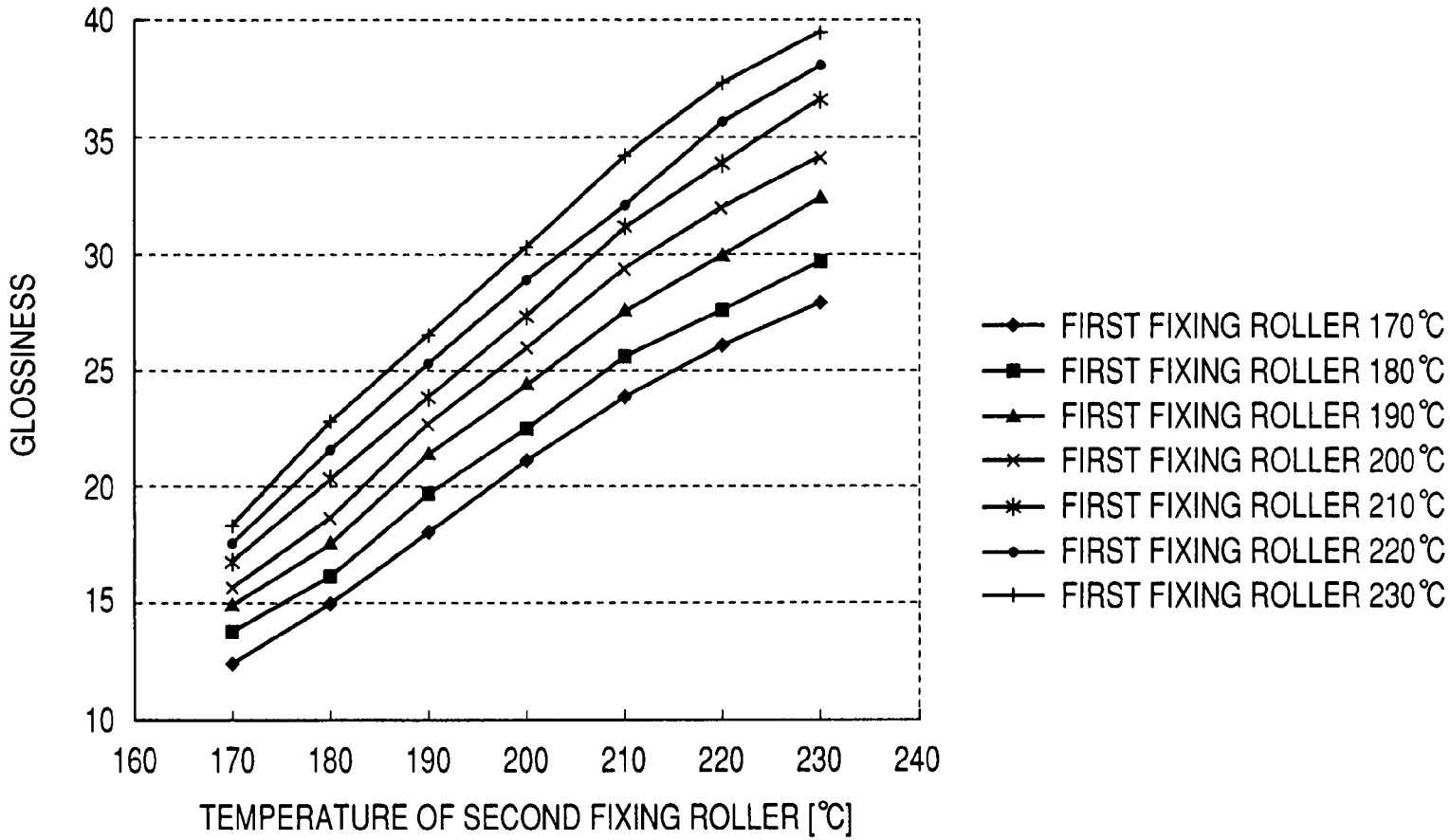
FIG. 6 is a graph representing characteristics of glossiness when changes occur to surface temperatures of a first fixing roller and a second fixing roller according to a first embodiment of the present invention.

FIG. 6 is a graph showing the glossiness when the temperatures of the first fixing roller 1 and the second fixing roller 3 are arbitrarily changed, and the tandem fixing is carried out. In FIG. 6, individual lines in the graph represent the temperatures of the first fixing roller 1, an axis of abscissa represents the temperature of the second fixing roller 3, and an axis of ordinate represents the glossiness.

Conversely considering, it becomes clear from the graph shown in FIG. 6 what temperature of the second fixing roller 3 gives desired glossiness (the glossiness of about 21.5 when the temperature of the first fixing roller 1 is 190° C. and the temperature of the second fixing roller 3 is 190° C. in the first embodiment) when the temperature of the first fixing roller 1 is changed in a range of 170° C. to 230° C.

Figure 7:
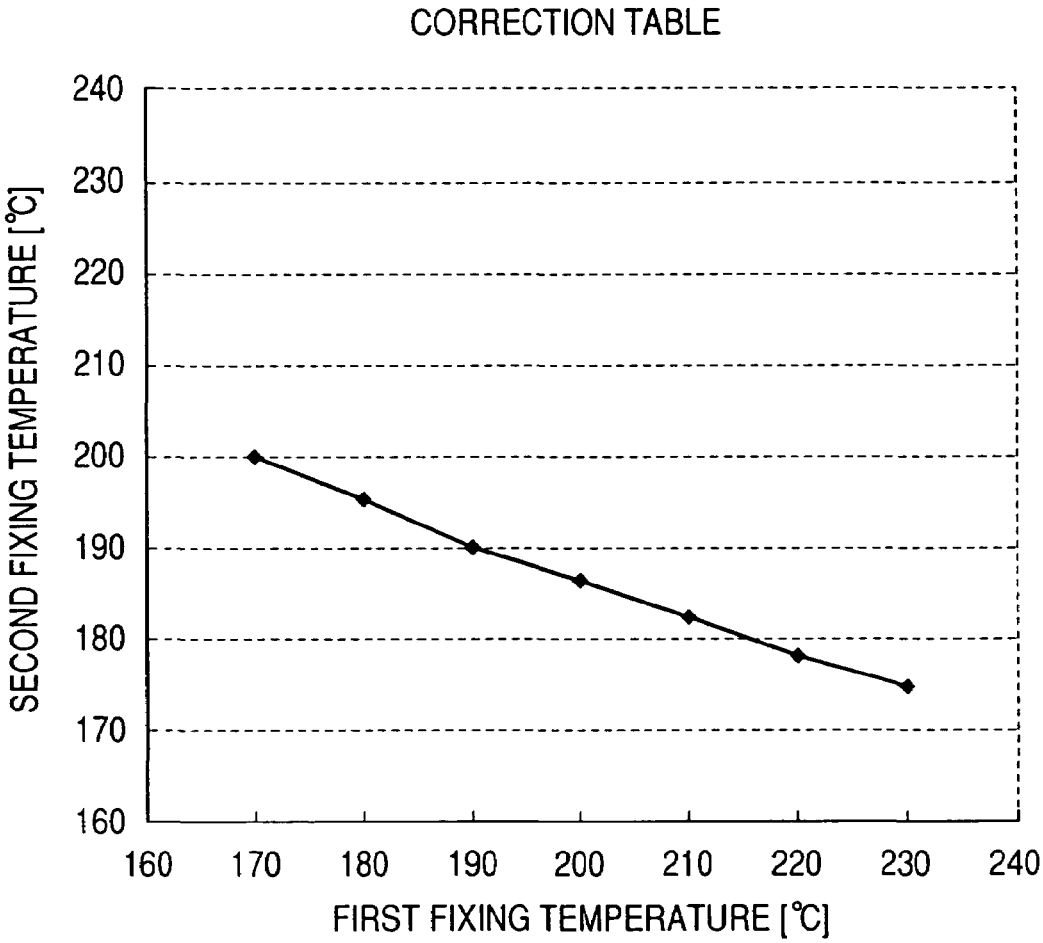
FIG. 7 is a graph guiding a relationship among a temperature of the first fixing roller, a temperature of the second fixing roller, and condition coefficients k and L when predetermined glossiness is obtained in the first embodiment of the present invention.

A graph shown in FIG. 7 derives a relationship between the temperature of the first fixing roller 1 and the temperature of the second fixing roller 3 when the reference value of the glossiness is set to 21.5 from those graphs.

Making approximation from the graph shown in FIG. 7, a transformation equation for obtaining the glossiness of 21.5 is found as follows:

$$(\text{Temperature of second fixing roller}) = -0.42 \times (\text{temperature of first fixing roller}) + 269.8\ (^\circ\text{C.}) \quad \text{(Equation 1)}$$

That is, the temperature control is carried out for the change in temperature of the first fixing roller 1 so as to obtain the temperature of the second fixing roller 3 found in Equation 1, whereby it becomes possible to provide an image having given glossiness irrespective of the temperature of the first fixing roller 1.

Figure 8:
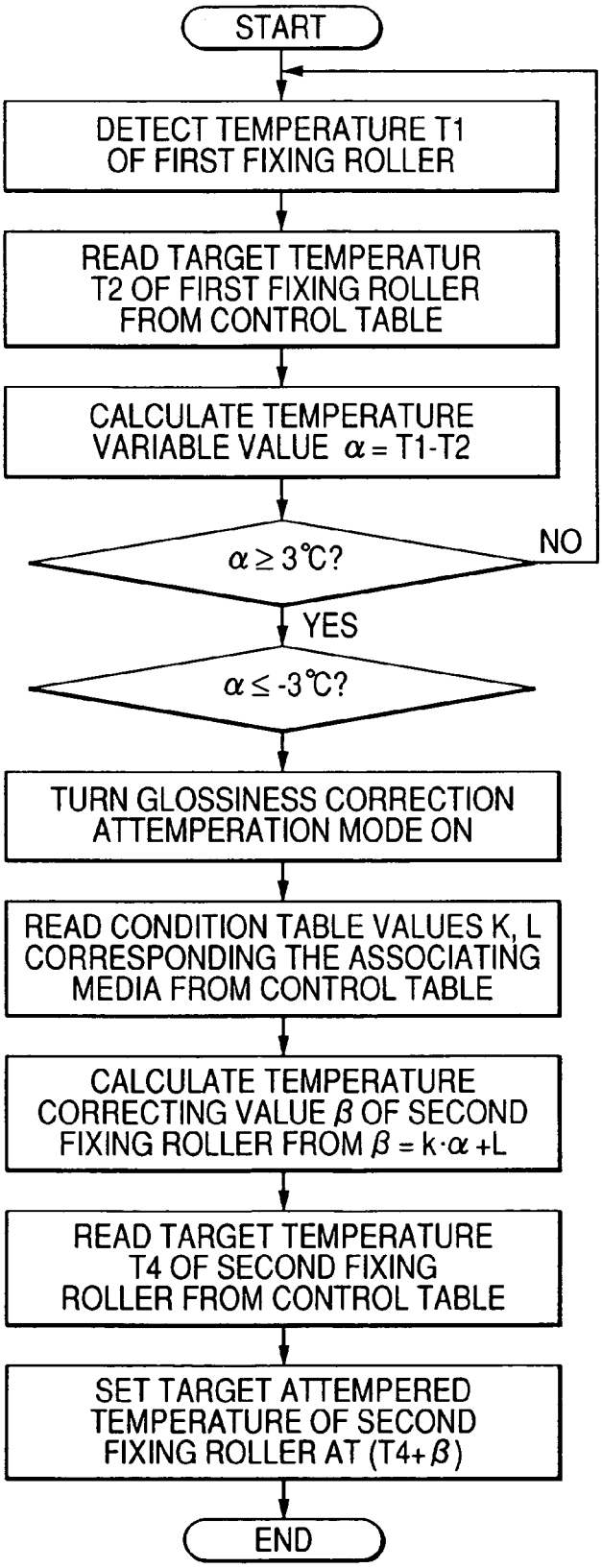
FIG. 8 is a flow chart of a method of controlling a temperature of a second fixing unit so as to compensate for a change in temperature of a first fixing unit.

Here, a description will be given with respect to a method of controlling the temperature of the second fixing unit B so as to compensate for a change in temperature of the first fixing unit A. The control method is a feature of the present invention. FIG. 8 is a flow chart showing the control method. Hereinafter, such a control state will be referred to as "a glossiness correcting attemperation mode".

When the surface temperature of the first fixing roller 1 detected by the thermister 15 is T1, and the target temperature of the first fixing roller 1 is T2, the attemperation circuit 10 has a function of obtaining a difference between the surface temperature T1 of the first fixing roller 1 and the target temperature T2 of the first fixing roller 1 as a temperature variable value "$\alpha$=T1−T2" of the first fixing roller 1.

Next, when the temperature variable value $\alpha$ of the first fixing roller 1 exceeds a temperature ripple during non-sheet supply which the first fixing roller 1 has in a normal attemperation state, the control state enters the glossiness correcting attemperation mode.

Here, in a case of the fixing apparatus having a large temperature ripple, a temperature margin is required all the more for it is related to the decision on whether or not an attemperation is to proceed from a normal attemperation mode (a mode in which the attemperation of the first fixing unit A and the attemperation of the second fixing unit B are carried out independently of each other) to the glossiness correcting attemperation mode.

Conversely speaking, the fixing apparatus construction is preferably designed so that a maximum allowable temperature ripple is calculated from a target value of a maximum amplitude of the glossiness change, and the temperature ripple falls within the maximum allowable temperature ripple.

Here, since the temperature ripple largely depends on a heat capacity and a heat conductivity of the fixing roller, the construction having a lower heat capacity is desirably adopted, and also the construction having higher heat conductivity is desirably adopted.

In the first embodiment, the rubber material with a small thickness, concretely, the silicon rubber material with a thickness of 500 μm is used as the rubber layer of the fixing roller, and the core metal with a small thickness, concretely, the aluminum material with a thickness of 1.0 mm is further used in the fixing roller, whereby the temperature ripple in the normal state is suppressed within 3° C.

As a result, the maximum amplitude of the glossiness change in the glossiness correcting attemperation mode can be suppressed to the target value or smaller.

Note that the heating source of the fixing roller maybe changed from the above-mentioned halogen heater to an electromagnetic induction heater (IH heater) which is excellent in heat responsibility. Moreover, a noncontact type infrared detecting sensor having a higher responsibility is used as the temperature detecting means instead of the thermister, and the pressure roller is changed to an endless belt with a small thickness in order to make the heat capacity lower, whereby it is possible to further enhance the effect.

In the first embodiment, when the temperature variable value α of the first fixing roller 1 becomes in absolute value equal to or higher than 3° C., i.e., when α becomes equal to or lower than −3° C. or equal to or higher than 3° C., the attemperation mode enters the glossiness correcting attemperation mode.

In addition, when the continuous fixing processing for a plurality of recording materials is completed or the temperature variable value α of the first fixing roller 1 becomes equal to or lower than 1.5° C. after the attemperation mode has entered the glossiness correcting attemperation mode, the attemperation mode speedily returns back to the normal attemperation mode.

Here, when the target temperature of the second fixing roller 3 in the normal state is T4, in the glossiness correcting attemperation mode, the temperature control for the second fixing roller 3 is carried out based on a value, (T4+β)° C., which is obtained by adding a temperature correcting value β of the second fixing roller 3 to the original target temperature T4 of the second fixing roller 3.

That is, when Equation 1 is expressed using the correcting values α and β, in the first embodiment, Equation 1 is transformed into the following equation:

$$T4+\beta=-0.42\times T1+269.8,$$

$$T4+\beta=-0.42\times(\alpha+T2)+269.8$$

Here, since the correcting values α=190° C. and β=190° C. in the first embodiment, Equation 2 is obtained as follows:

$$\beta=-0.42\times\alpha \qquad \text{(Equation 2).}$$

Here, since α and β are calculated as integral numbers by the temperature of 1° C. in terms of the temperature control for the attemperation circuit 10, in the actual control, fractions of 0.5 and over are counted as one and the rest is disregarded.

The attemperation circuit 10 checks a change in temperature of the first fixing roller 1. When the absolute value of the temperature variable value α as the difference between the target temperature T2 during the continuous fixing processing and the temperature T1 detected by the thermister 15 becomes equal to or larger than 3 in absolute value, the attemperation circuit 10 carries out the temperature control based on the target temperature T4 of the second fixing roller 3 in the normal state and the correcting value obtained from Equation 2 so that the temperature of the second fixing roller 3 becomes (T4+β)° C. As a result, the image having desired glossiness can be continuously provided during the image forming job irrespective of a change in temperature of the first fixing roller 1.

Here, −0.42 as the coefficient representing a relationship between the correcting values β and α in the conversion equation is one which is determined based on compositeness of the various factors such as the attemperation temperatures and nip widths of the first fixing roller 1 and the second fixing roller 3, the glossiness of the recording material, the basis weight of the recording material, and the fusing characteristic of the toner. Thus, −0.42 as the coefficient is a specific value which is obtained by carrying out the experiments under predetermined conditions, i.e., a condition coefficient k.

That is, this relationship is expressed in the form of an equation as follows:

$$\beta=k\cdot\alpha+L \qquad \text{(Equation 3)}$$

where L is a coefficient with which an error during the approximation is adjusted.

Thus, for example, only the basis weight of the recording material is changed, but other conditions are fixed in order to derive the condition coefficient k, and the recording material is optimized every basis weight of the recording material to be fed back, whereby even when the fixing processing is continuously executed for the recording materials having different basis weights, it becomes possible to output images having respective uniform desired glossiness.

The results of the actual experiments about changes in temperatures of the first fixing roller 1 and the second fixing roller 3 and a change in glossiness under the above-mentioned control will hereinafter be described.

Figure 9:
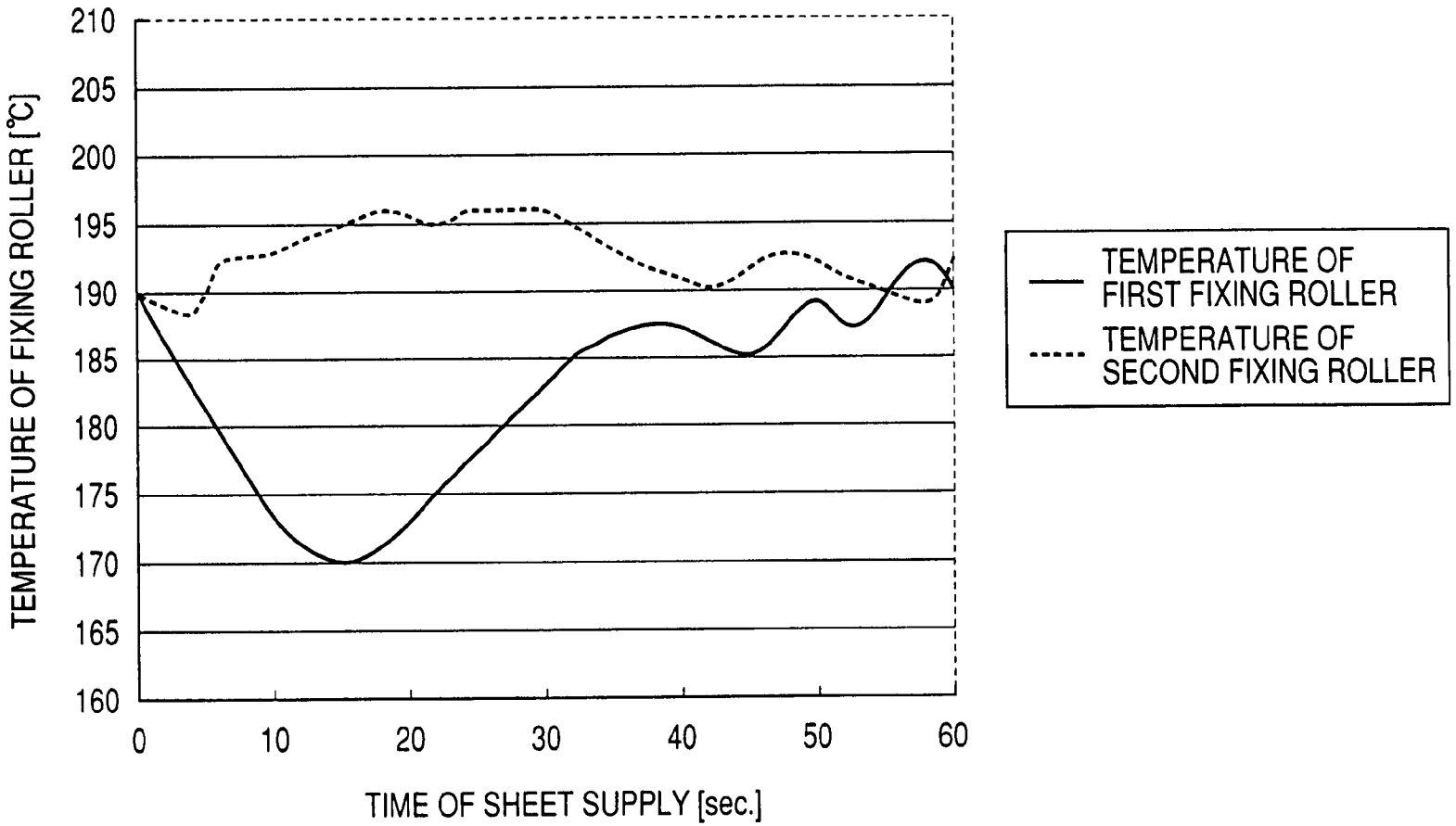
FIG. 9 is a graph representing changes in surface temperatures of the first fixing roller and the second fixing roller when a glossiness correcting attemperation mode is in an on state in the first embodiment of the present invention.

FIG. 9 is a graph showing changes in temperatures T1 and T3 of the first fixing roller 1 and the second fixing roller 3 in a case where the glossiness correcting attemperation mode is carried out when the target temperature T2 of the first fixing unit A in the normal attemperation mode is set to 190° C., and the target temperature T4 of the second fixing unit B in the normal attemperation mode is set to 190° C.

Figure 10:
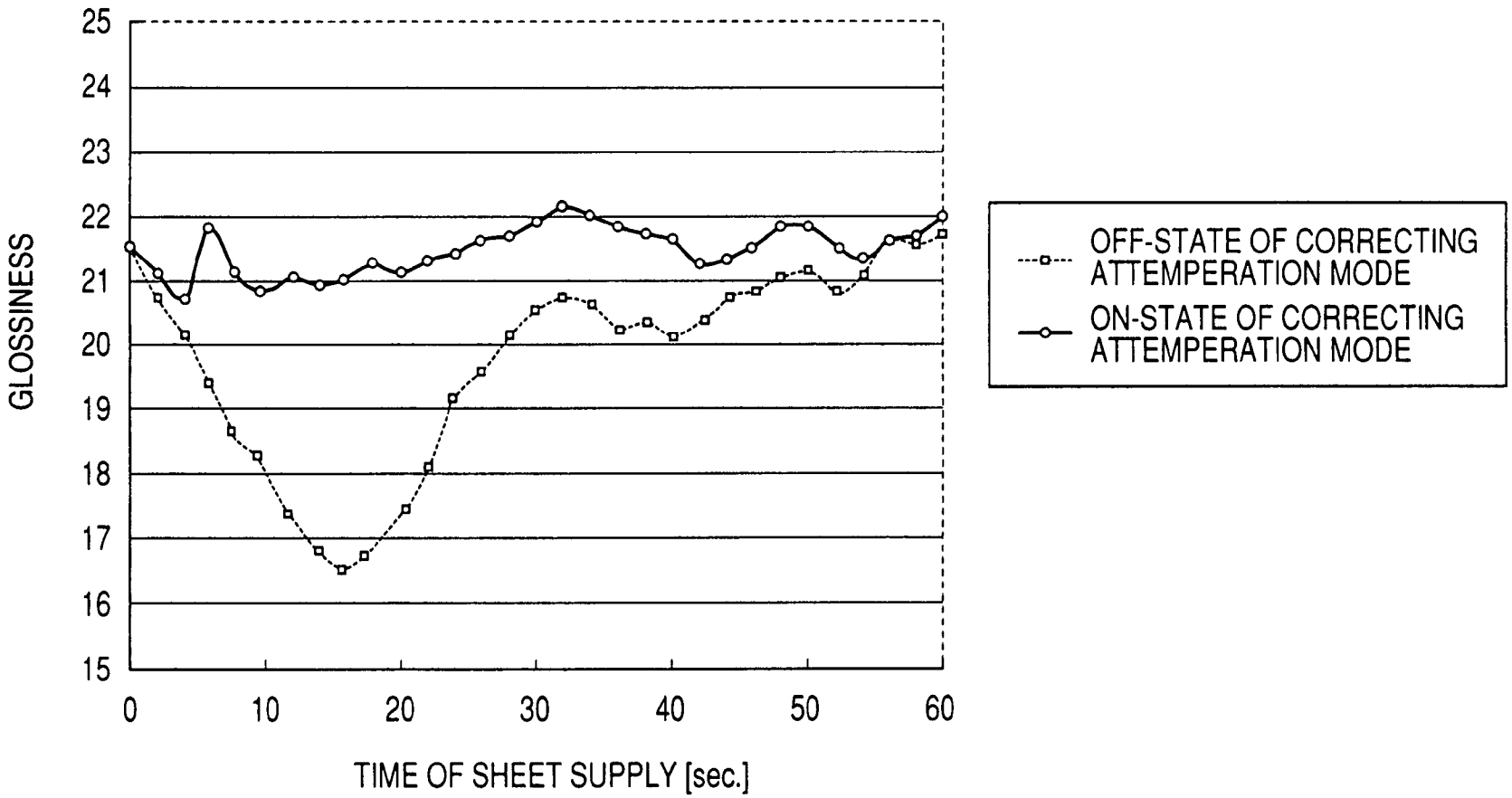
FIG. 10 is a graph representing a change when the glossiness correcting attemperation mode is in an off state and a change when the glossiness correcting attemperation mode is in an on state according to a first embodiment of the present invention.

In addition, FIG. 10 is a graph showing a change in glossiness of the image (patch) when the glossiness correcting attemperation mode is carried out.

As can be seen from FIG. 9, when the surface temperature T1 of the first fixing roller 1 drops, for the surface temperature T3 of the second fixing roller 3, in order to maintain the final glossiness, the attemperation circuit 10 changes the target temperature T4 in the normal attemperation mode over to a target temperature T4' which is higher than the target temperature T4 by the temperature correcting value β and then acts to maintain the target temperature T4' as it is.

On the other hand, when the surface temperature T1 of the first fixing roller 1 overshoots to become higher than the target temperature T2, the attemperation circuit 10 changes the target temperature T4 in the normal attemperation mode to the target temperature T4' which is lower than the target temperature T4 by the temperature correcting value β and then acts to maintain the target temperature T4' as it is.

More strictly speaking, the surface temperature of the second fixing roller 3 slightly drops due to delay of the temperature rise owing to a thermal time constant of the second fixing roller 3, as well as due to the sheet supply of the recording material. Hence, there is a slight difference between the target temperature (T4+β)° C. and the surface temperature T3 in the glossiness correcting attemperation mode. However, the optimization can be carried out by finely adjusting the condition coefficient L (the value 0 in the first embodiment) which has already been described.

Here, as can be seen from FIG. 10, the glossiness correcting attemperation mode (an on-state of the correcting attemperation mode) described above is provided and carried out, whereby the desired glossiness, concretely, the glossiness of about 21.5±0.7 can be stably obtained as compared with the case of the change in glossiness when the conventional normal attemperation mode (an off-state of the correcting attemperation mode) is carried out.

As described above, there is used "the glossiness correcting attemperation mode", described in the first embodiment, as the method of controlling the temperature of the second fixing unit B so as to compensate for the change in temperature of the first fixing unit A, whereby changes in glossiness of the individual toner images can be suppressed and nearly unified among the jobs for continuously subjecting a plurality of recording materials to the fixing processing.

In addition, according to the construction of the first embodiment, not only the glossiness of the image, but also the fixing characteristic of the image to the recording material can be stably maintained. This is a natural result because the control is carried out based on the glossiness correcting attemperation mode so that a total amount of heat which is supplied from the two fixing units to the recording material and the toner is usually held nearly constant.

Note that while in the foregoing, the description has been given with respect to the example in which both the heating members and the pressure members which the respective fixing units have are constituted by the rollers, for example, a constitution may also be adopted in which endless belts are used as either or both of the heating members and the pressure members.

Second Embodiment

Figure 11:
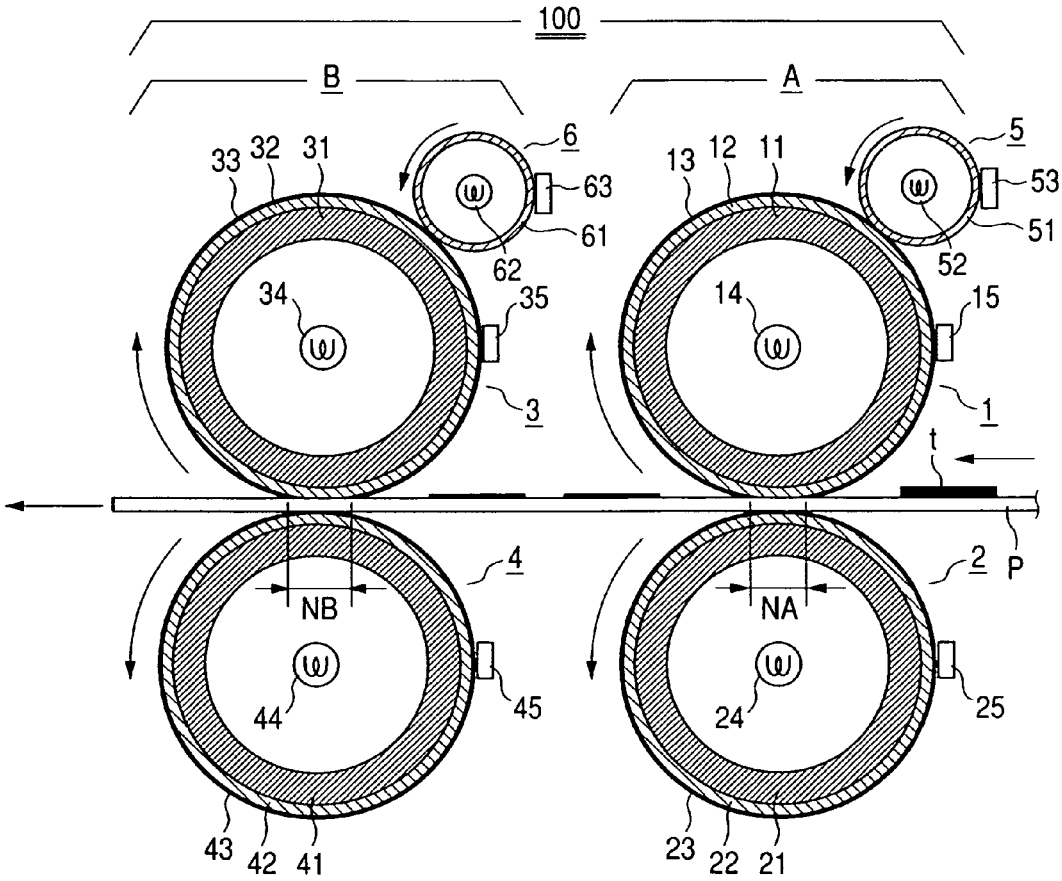
FIG. 11 is an enlarged schematic view of a fixing apparatus portion according to a second embodiment of the present invention.
Figure 12:
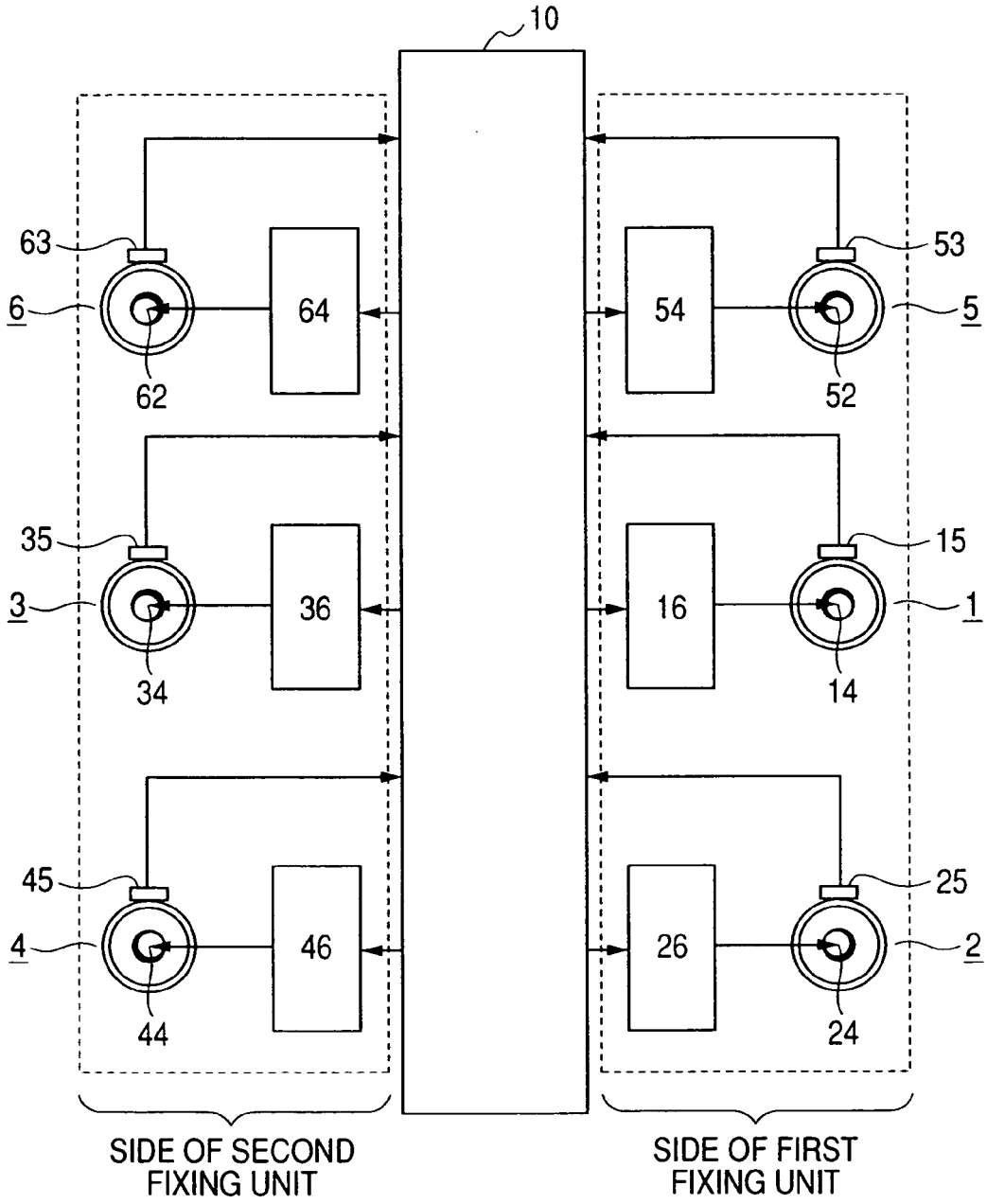
FIG. 12 is a block diagram of an attemperation system of a fixing apparatus according to the second embodiment of the present invention.
Figure 14:
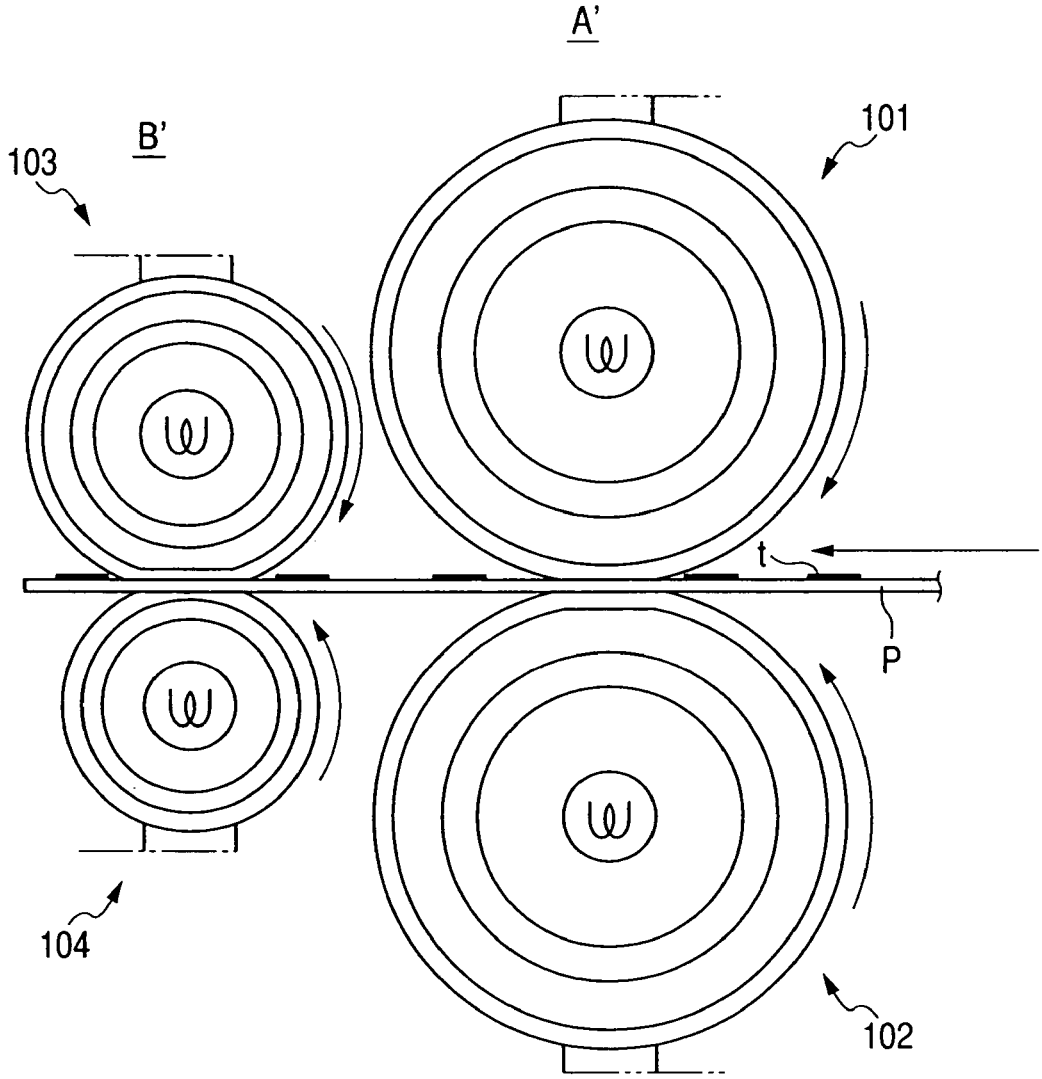
FIG. 14 is a schematic view showing a schematic construction of a conventional tandem fixing apparatus.

FIG. 11 is an enlarged schematic view of a fixing apparatus 100 according to a second embodiment of the present invention. FIG. 12 is a block diagram of an attemperation system of the fixing apparatus 100 shown in FIG. 11. The fixing apparatus 100 of the second embodiment is constructed such that the first fixing roller 1 and the second fixing roller 3 of the fixing apparatus 100 shown in FIG. 2 are further provided with a first external heating apparatus 5 and a second external heating apparatus 6, respectively.

The first external heating apparatus 5 is an apparatus for heating the first fixing roller 1 from the outside. The first external heating apparatus 5 includes a first external heating roller 51 constituted by a cylindrical base made of an aluminum material with a thickness of 2.0 mm, a halogen heater 52 of 600 W which is disposed inside the first external heating roller 51, and a thermister 53 electrically connected to the attemperation circuit 10 for detecting a surface temperature of the first external heating roller 51.

The second external heating apparatus 6 is an apparatus for heating the second fixing roller 3 from the outside. The second external heating apparatus 6 includes a second external heating roller 61 constituted by a cylindrical base made of an aluminum material with a thickness of 2.0 mm, a halogen heater 62 of 600 W which is disposed inside the second external heating roller 61, and a thermister 63 electrically connected to the attemperation circuit 10 for detecting a surface temperature of the second external heating roller 61.

The other members are the same as the corresponding components of the first embodiment described above unless specifically mentioned otherwise. In addition, the first external heating apparatus 5 and the second external heating apparatus 6 are constructed so as to be changeable between a detached state and a contact state with respect to the first fixing roller 1 and the second fixing roller 3 using a pressure mechanism (not shown). In addition, external heating nip portions formed between the first and second external heating apparatuses 5 and 6, and the first and second fixing rollers 1 and 3 are constructed so as to have predetermined widths in the contact state, respectively.

A feature of the second embodiment is that the temperature correcting value $\beta$ is calculated from: the temperature variable value $\alpha$ of the first fixing roller 1 as the difference between the surface temperature T1 of the first fixing roller 1 and the target temperature T2 thereof in the normal state; and the predetermined conversion equation, and is fed back to the target temperature T4 of the second fixing roller 3 and the target temperature T8 of the second external heating roller 61, respectively, thereby outputting the images each having uniform glossiness while the fixing processing is continuously executed.

Here, description of the reason for requiring the first and second external heating apparatuses 5 and 6 will be given in detail. In the first embodiment, the heating sources for the first fixing roller 1 and the second fixing roller 3 are constituted only by the halogen heaters 14 and 34 which are disposed inside the first fixing roller 1 and the second fixing roller 3, respectively. When the speed of the fixing processing is intended to be further increased in order to cope with the needs in the market, an amount of heat absorbed in the recording material increases with the speed. Thus, in order to maintain the surface temperatures of the first fixing roller 1 and the second fixing roller 3, it is preferable to increase a heating amount.

Thus, it is desirable that the first fixing roller 1 and the second fixing roller 3 be heated not only from their internal sides, but also from their external sides, thereby efficiently promoting an increase in heating amount. In addition, even if an amount of heat given from the internal side of the fixing roller is simply increased with the processing speed, the temperature of the external surface of the fixing roller does not speedily recover due to the heat capacity of the elastic layer of the fixing roller, and the thermal time constant. Moreover, if an amount of heat supplied from the inside of the fixing roller is too much, the temperature of the core metal of the fixing roller becomes high. As a result, a bad effect evil is caused in which a primer layer bridging the core metal and elastic layer of the fixing roller is destroyed to shorten the life of the fixing roller.

On the other hand, in the tandem fixing apparatus using the conventional external heating apparatus, the temperature control for the first fixing unit and the temperature control for the second fixing unit are carried out independently of each other. Hence, as has already been described in the first embodiment, when the continuous fixing processing is executed, the temperature of the first fixing roller 1 changes. Thus, this temperature change becomes a problem in terms of outputting the image having the desired uniform glossiness.

In the second embodiment, firstly, similarly to the first embodiment, the condition coefficient k for the temperature variable value $\alpha$ of the first fixing roller and the temperature correcting value $\beta$ is derived with which the desired glossiness can be obtained under the conditions such as the predetermined fixing processing speed, the kind of predetermined recording material, the surface temperature T1 of the first fixing roller 1, and the surface temperature T3 of the second fixing roller 3.

Moreover, the attemperation circuit 10 checks the change in temperature of the first fixing roller 1. When the absolute value of the temperature variable value $\alpha$ as the difference between the target temperature T2 of the first fixing roller 1 during the continuous sheet supply and the temperature T1 thereof detected by the thermister 15 becomes equal to or larger than the predetermined value, the attemperation circuit 10 carries out the temperature control based on the target temperature T4 of the second fixing roller 3 in the normal state and the correcting value obtained from the conversion equation of $\beta=k\cdot\alpha$ to change the target temperature of the second external heating roller 61 and the target temperature of the second fixing roller 2 to (T8+$\beta$)° C. and (T4+$\beta$)° C., respectively, so that the surface temperature of the second fixing roller 3 becomes (T4+$\beta$)° C. As a result, the image having the predetermined glossiness can be provided irrespective of the temperature of the first fixing roller 1.

Third Embodiment

A feature of a third embodiment is how to set and select the condition coefficients k and L which are required when the target temperature of at least one of the second fixing roller (heating member) 3, second external heating roller (external heating apparatus) 61, and second pressure roller (pressure member) 4 of the second fixing unit B is controlled so as to compensate for a change in temperature of at least one of the first fixing roller (heating member) 1, first external heating roller (external heating apparatus) 51, and first pressure roller (pressure member) 2 of the first fixing unit A.

When attribute information such as the basis weight of the recording material, the moisture content, and the glossiness of the recording material is derived from the temperature control table which was made based on the attribute information such as the basis weight of the recording material, the moisture content, and the glossiness of the recording material, and is then inputted to the image forming apparatus, the temperature control is carried out with the attemperation table which was produced from the suitable condition coefficients k and L.

More specifically, as has already been described in the first embodiment, the relationship between the surface temperature T1 of the first fixing roller 1 and the glossiness of the image corresponding to the surface temperature T3 of the second fixing roller 3 can be derived from the graph as shown in FIG. 6. Moreover, the temperatures of the first fixing roller 1 and the second fixing roller 3 which are required when a predetermined glossiness is obtained from the graph shown in FIG. 6 can be derived from the following approximate equation as obtained from the relationship as shown in FIG. 7:

$$\beta=k\cdot\alpha+L \qquad \text{(Equation 3)}$$

Thus, for example, the basis weights of the recording materials are assigned to four stages, i.e., 80 g/m$^2$, 100 g/m$^2$, 160 g/m$^2$, and 200 g/m$^2$, and the characteristic graphs as shown in FIGS. 6 and 7 are produced using the above-mentioned method, thereby making it possible to obtain the condition coefficients k1 to k4 and L1 to L4 for the respective basis weights.

FIG. 13 shows a table of the condition coefficients k and L which are derived from the four-stage basis weights of the recording materials and the three-stage moisture contents of the recording materials when the glossiness of 21.5 is actually obtained with the construction described in the first embodiment.

The optimal conditions are usually derived by utilizing a method in which the image forming apparatus in advance has the table of such condition coefficients k and L on each of the desired glossiness and basis weight, glossiness, and moisture content of the recording material, and the image forming apparatus has a function of detecting such information in order to feed back such information, or a user inputs the information on the desired glossiness, inputs or selects the information on the recording material to be used. Under this condition, the fixing apparatus executes the temperature control processing. As a result, even under the various conditions, when the continuous fixing processing is executed, the image having the uniform desired glossiness can be usually outputted.

As described above, in the tandem fixing apparatus for continuously carrying out the fixing processing process, the target temperature of the second fixing unit is controlled so as to compensate for a change in temperature of the first fixing unit, whereby the image having the uniform desired glossiness can be obtained without changing the fixing speed.

When the recording materials are intended to be continuously subjected to the fixing processing at the increased image forming speed, or the recording materials having different basis weights (a thin paper, a cardboard, and the like) and mixedly prepared are intended to be continuously subjected to the fixing processing to aim at the same function as that of the printer in order to cope with the needs in the market which will further diversify, the first fixing unit A needs to be heated from a room temperature to 140° C. or higher for example (this value changes depending on the image forming speed or a softening point of the toner) in order to ensure the minimum fixing characteristic. Thus, the great heating power is required. Here, the first fixing unit A can usually desirably maintain a predetermined temperature even in any state. However, actually, suppression of the temperature change when the fixing processing is continuously executed becomes more difficult as an image forming speed becomes faster or the number of sheets in a continuous image formation becomes larger. That is, the internal heat source of the first fixing unit A does not require the heating power so much in a so-called standby state in which no image is formed. Thus, the heat source is not in an on-state at all times, and hence an amount of heat accumulation is small. On the other hand, in a state where the image is formed and thus the sheets are continuously supplied, the heating source is continuously in an on-state in order to maintain the surface temperature of the heating member. Hence, even when the surface temperature of the heating member is the same as that in the standby state, an amount of heat accumulation within the fixing roller becomes large. A difference between the amounts of heat accumulation corresponding to the state change becomes more remarkable as the high speed promotion and the continuance promotion are further realized.

For this reason, when the operation state proceeds from the standby state to the image formation state and the heat accumulated in the first fixing unit begins to be absorbed by the recording material, for a given period of time when the heating source begins to be fully turned on and its heat reaches the surface of the heating member, the temperature of the first fixing unit A drops by the difference in amount of heat accumulation. As a result, the surface temperature of the heating member of the first fixing unit A becomes temporarily lower than the target temperature. In order to avoid this situation, an amount of heat accumulation of the heating member in the standby state needs to be made equal to that of the heating member in the continuous sheet supply state. However, as a matter of course, since the recording material adapted to absorb the heat of the heating member is absent in the standby state, the surface temperature of the heating member over-rises. As a result, the toner on the recording material which is firstly supplied is excessively molten, and a change in glossiness due to the hot offset or the over-melting. Hence, it becomes impossible to attain the original object.

On the other hand, when the sheet supply process is temporarily stopped (e.g., in the image adjusting processing), since there is no recording material adapted to absorb the heat of the surface of the fixing roller, a so-called overshoot is generated in which the temperature of the fixing roller rises over the attemperation temperature. Thus, if the overshoot is not settled at a time point when the sheet supply process is restarted, the surface temperature of the heating member of the first fixing unit A becomes temporarily higher than the target temperature in some cases. As regards a method of avoiding this situation, for example, there is known a method in which the sheet supply process continues to be stopped until the overshoot is perfectly settled. However, as a matter of course, this method leads to that the productivity of the image forming apparatus is reduced to impair a profit of a user.

In addition, it is self-evident that when the recording materials having different basis weights (a cardboard, a thin paper, and the like) are continuously subjected to the fixing processing, the temperature maintained in the fixing unit A rises and falls in accordance with the state of the recording materials (the weights, the moisture contents, and the like of the sheet).

For this reason, in a case where the recording materials having different basis weights are mixedly prepared, there arises a problem in that when the recording material which has been subjected to the fixing processing once in the first fixing unit A is made pass through the second fixing unit B at a given temperature, actually, the glossiness and the fixing characteristic change in accordance with a change in temperature of the first fixing unit A.

As regards a measure for solving this problem, for example, it is the simplest settlement measure that the basis weights and moisture contents of the recording materials to be continuously subjected to the fixing processing are unified to suppress a change in temperature of the fixing unit A. However, in a case where the recording materials having different basis weights are not mixedly prepared, for example, in a blockbinding processing (for collectively forming images on the recording materials having different basis weights for a book, a catalog, a manual, and the like), it becomes impossible to collectively carry out the complicated image formation in which a glossy sheet having a large basis weight is used as a cover, and sheets each of which has a small basis weight and which are easy to turn are used as the intermediate recording materials. Thus, it becomes impossible to fulfill the request of a user who wants to use the bookbinding processing function as a printing apparatus.

As described above, in the tandem fixing apparatus for continuously carrying out the fixing processing process, an image having uniform desired glossiness can be outputted without changing the fixing speed. Such an excellent effect cannot be attained with any other means than the tandem fixing apparatus, and also cannot be attained with the tandem fixing apparatus having no means for correlating the temperature control for the first fixing unit and the temperature control for the second fixing unit.

Summarizing the foregoing, according to the construction of the third embodiment, the temperature of the second fixing unit is controlled so as to compensate for a change in temperature of the first fixing unit, whereby even when the temperature of the first fixing unit drops or rises, an image having uniform desired glossiness can be outputted without changing the fixing speed.

In addition, the temperature of the external heating member of the second fixing unit is controlled so as to compensate for a change in temperature of the first fixing unit, whereby it is possible to more speedily cope with a change in temperature.

Moreover, the control operation is carried out based on the attribute information such as the basis weight of the recording material, the ambient atmosphere within the apparatus (concretely, the moisture content), the gloss value of the recording material, and the gloss value of the image to be outputted using the above-mentioned temperature control table, whereby an image having uniform desired glossiness can be outputted more precisely without changing the fixing speed.

This application claims priority from Japanese Patent Application No. 2004-175629 filed on Jun. 14, 2004, which is hereby incorporated by reference herein.

What is claimed is:

1. An image heating apparatus, comprising:

a first image heating device which heats a toner image on a recording material at a first nip portion;

a second image heating device, provided at downstream side of the first image heating device in a conveying direction of the recording material, which heats the toner image on the recording material heated by the first image heating device at a second nip portion;

a detector which detects a temperature of the first image heating device; and a controller which controls a temperature of the second image heating device so as to maintain a target temperature, wherein the image heating apparatus is operable to a correcting mode in which the target temperature of the second image heating device is corrected in accordance with the temperature of the first image heating device detected by the detector.

2. An image heating apparatus according to claim 1, wherein in the correcting mode, the target temperature of the second image heating device is corrected so that glossiness of the image on the recording material subjected to a heat processing by the first image heating device and the second image heating device falls within a predetermined range.

3. An image heating apparatus according to claim 1, wherein in the correcting mode, when the temperature of the first image heating device detected by the detector rises, the target temperature of the second image heating device is reduced, and when the temperature of the first image heating device detected by the detector drops, the target temperature of the second image heating device is raised.

4. An image heating apparatus according to claim 1, wherein the image heating apparatus is operable to a normal mode in which a temperature control for the first image heating device and a temperature control for the second image heating device are carried out independently of each other.

5. An image heating apparatus according to claim 4, further comprising a switching device which switches between the correcting mode and the normal mode in accordance with the temperature of the first image heating device detected by the detector.

6. An image heating apparatus according to claim 1, wherein the second image heating device includes a first rotating member for heating the image on the recording material at the second nip portion, a second rotating member for forming the second nip portion between the first rotating member and itself, and an external heating member for heating the first rotating member from an outside, and in the correcting mode, a heating operation of the external heating member is corrected in accordance with the temperature of the first image heating device detected by the detector.

7. A fixing apparatus, comprising:

a first fixing device which heat-fixes a toner image on a recording material;

a second fixing device, provided at a downstream side of the first fixing device in a conveying direction of the recording material, which heat-fixes the toner image on the recording material heated by the first fixing device;

a detector which detects a temperature of the first fixing device; and a controller which controls a temperature of the second fixing device so as to maintain a target temperature, wherein the fixing apparatus is operable to a correcting mode in which the target temperature of the second fixing device is corrected in accordance with the temperature of the first fixing device detected by the detector.

8. A fixing apparatus according to claim 7, wherein in the correcting mode, the target temperature of the second fixing device is corrected so that glossiness of the image on the recording material subjected to a heat processing by the first fixing device and the second fixing device falls within a predetermined range.

9. A fixing apparatus according to claim 7, wherein in the correcting mode, when the temperature of the first fixing device detected by the detector rises, the target temperature of the second fixing device is reduced, and when the temperature of the first fixing device detected by the detector drops, the target temperature of the second fixing device is raised.

10. A fixing apparatus according to claim 7, wherein the fixing apparatus is operable to a normal mode in which a temperature control for the first fixing device and a temperature control for the second fixing device are carried out independently of each other.

11. A fixing apparatus according to claim 10, further comprising a switching device which switches between the correcting mode and the normal mode in accordance with the temperature of the first fixing device detected by the detector.

12. A fixing apparatus according to claim 7, wherein the second fixing device includes a first rotating member for heating the image on the recording material at a nip portion, a second rotating member for forming the nip portion between the first rotating member and itself, and an external heating member for heating the first rotating member from an outside, and in the correcting mode, a heating operation of the external heating member is corrected in accordance with the temperature of the first fixing device detected by the detector.

13. An image heating apparatus, comprising:

a first image heating device which heats a toner image on a recording material at a first nip portion;

a first heater which heats the first image heating device so that a temperature of the first image heating device maintains a first target temperature;

a second image heating device, provided at a downstream side of the first image heating device in a conveying direction of the recording material, which heats the toner image on the recording material heated by the first image heating device at a second nip portion; a second heater which heats the second image heating device so that a temperature of the second image heating device maintains a second target temperature; and a correcting device which corrects the second target temperature in accordance with a temperature of the first image heating device.

14. An image heating apparatus according to claim 13, wherein the correcting device corrects the second target temperature so that glossiness of the image on the recording material subjected to a heat processing by the first image heating device and the second image heating device falls within a predetermined range.

15. An image heating apparatus according to claim 13, wherein when the temperature of the first image heating device rises, the correcting device reduces the second target temperature, and when the temperature of the first image heating device drops, the correcting device raises the second target temperature.

16. An image heating apparatus according to claim 13, further comprising a setting device which sets the first target temperature and the second target temperature in accordance with a kind of the recording material.

17. A fixing apparatus, comprising:

a first fixing device which heat-fixes a toner image on a recording material at a first nip portion;

a first heater which heats the first fixing device so that a temperature of the first fixing device maintains a first target temperature;

a second fixing device, provided at a downstream side of the first fixing device in a conveying direction of the recording material, which heat-fixes the toner image on the recording material heated by the first fixing device at a second nip portion;

a second heater which heats the second fixing device so that a temperature of the second fixing device maintains a second target temperature; and a correcting device which corrects the second target temperature in accordance with a temperature of the first fixing device.

18. A fixing apparatus according to claim 17, wherein the correcting device corrects the second target temperature so that glossiness of the image on the recording material subjected to a heat processing by the first fixing device and the second fixing device falls within a predetermined range.

19. A fixing apparatus according to claim 17, wherein when the temperature of the first fixing device rises, the correcting device reduces the second target temperature, and when the temperature of the first fixing device drops, the correcting device raises the second target temperature.

20. A fixing apparatus according to claim 17, further comprising a setting device which sets the first target temperature and the second target temperature in accordance with a kind of the recording material.

* * * * *

UNITED STATES PATENT AND TRADEMARK OFFICE

CERTIFICATE OF CORRECTION

PATENT NO. : 7,263,305 B2
APPLICATION NO. : 11/142394
DATED : August 28, 2007
INVENTOR(S) : Takeshi Fujino It is certified that error appears in the above-identified patent and that said Letters Patent is hereby corrected as shown below:

ON THE TITLE PAGE:
At Item (56), References Cited, Foreign Patent Document, "04136970 A" should read --4-136970 A--.

IN THE DRAWINGS:
Sheet No. 8, Figure 8, "TEMPERATUR" should read --TEMPERATURE--.

COLUMN 4:
Line 4, "flow chart" should read --flowchart--.

COLUMN 9:
Line 33, "point" should read --points--.

COLUMN 10:
Line 32, "flow chart" should read --flowchart--.

COLUMN 11:
Line 11, "maybe" should read --may be--.

COLUMN 17:
Line 10, "change in glossiness" should read --change in glossiness occurs--.
Line 27, "reduced to" should read --reduced so as to--.
Line 56, "has" should read --have--.

Signed and Sealed this

Seventeenth Day of June, 2008

JON W. DUDAS
*Director of the United States Patent and Trademark Office*